United States Patent [19]

Labbe et al.

[11] 3,949,763

[45] Apr. 13, 1976

[54] CIGARETTE MAKING MACHINES

[75] Inventors: Francis Auguste Maurice Labbe, Neuilly-sur-Seine, France; Clifford Russell Marritt, London, England

[73] Assignee: Molins Limited, London, England

[22] Filed: Sept. 10, 1973

[21] Appl. No.: 395,678

[30] Foreign Application Priority Data

Sept. 12, 1972 United Kingdom ..... 42358/72

[52] U.S. Cl. ..... 131/84 B

[51] Int. Cl.[2] ..... A24C 5/18

[58] Field of Search ..... 131/21 D, 84 B, 84 C

[56] References Cited

UNITED STATES PATENTS

| | | | |
|---|---|---|---|
| 3,189,034 | 6/1965 | Molins | 131/84 C |
| 3,288,147 | 11/1966 | Molins et al. | 131/84 C X |
| 3,306,304 | 2/1967 | Molins et al. | 131/21 D |
| 3,338,247 | 8/1967 | Labbe | 131/84 C X |
| 3,504,679 | 4/1970 | Lowman | 131/84 C |
| 3,732,871 | 5/1973 | Molins et al. | 131/84 C |

FOREIGN PATENTS OR APPLICATIONS

| | | | |
|---|---|---|---|
| 1,125,826 | 3/1962 | Germany | 131/84 B |
| 961,139 | 6/1964 | United Kingdom | 131/84 C |

*Primary Examiner*—Robert W. Michell
*Assistant Examiner*—V. Millin
*Attorney, Agent, or Firm*—John C. Smith, Jr.

[57] ABSTRACT

A cigarette making machine comprises means for feeding tobacco towards a part of the machine which forms the tobacco into a tobacco stream, a trimmer arranged to trim away part of the tobacco stream, and means for feeding the discard tobacco (i.e., the tobacco removed from the stream by the trimmer) back to the tobacco-stream-forming part of the machine. The trimmer is arranged so that it can remove a temporarily increased amount of tobacco while the machine is being started. In particular, the tobacco stream is formed by showering tobacco towards a conveyor on which the tobacco builds up into a tobacco stream; and the discard tobacco is showered towards the conveyor at a position such that it forms part of the tobacco stream which is not removed by the trimmer. The tobacco may be showered upwards with the aid of an air stream towards the conveyor.

11 Claims, 3 Drawing Figures

CIGARETTE MAKING MACHINES

According to the present invention, a cigarette making machine comprises means for feeding tobacco towards a part of the machine which forms the tobacco into a tobacco stream, a trimmer arranged to trim away part of the tobacco stream, and means for feeding the discard tobacco back to the tobacco-stream-forming part of the machine, the trimmer being so arranged that, while the machine is being started, it can remove a temporarily increased amount of tobacco from the tobacco stream.

It will be understood that the term "discard tobacco" is intended to refer to the tobacco removed from the tobacco stream by the trimmer.

Preferably the tobacco stream is formed by showering tobacco, possibly upwards with the aid of an airstream, towards a conveyor on which the tobacco builds up into a tobacco stream; and the discard tobacco is showered towards the conveyor at a position such that it forms part of the tobacco stream which is not removed by the trimmer. For this purpose the discard tobacco is preferably fed towards the tobacco stream separately from the fresh tobacco delivered into the machine. For example, the discard tobacco, or at least part of it, may be fed substantially directly into the tobacco shower without being handled by all the carded drum and/or other feed devices used to feed the incoming fresh tobacco; thus the discard tobacco, which is already well loosened and probably also winnowed, avoids significant further degradation which may be caused by handling of the discard tobacco by the carded drum or other devices which are required to loosen the incoming fresh tobacco.

Examples of machines according to this invention will now be described with reference to the accompanying drawings. In these drawings.

Figure 1:
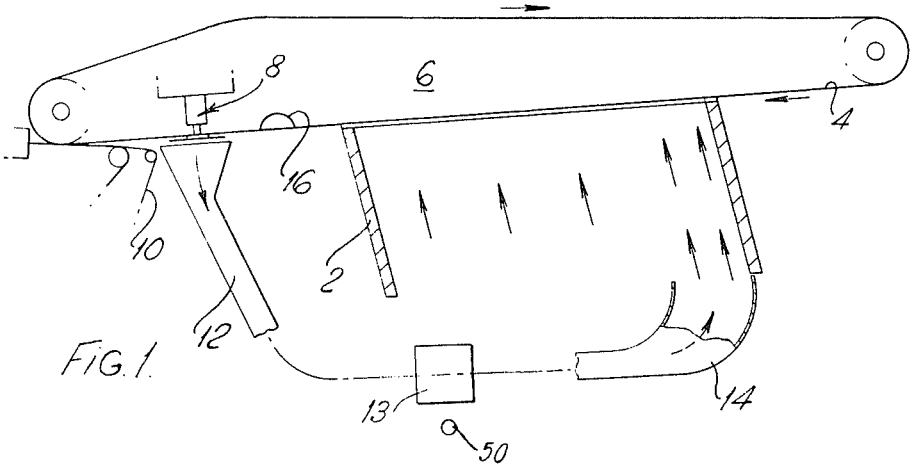
FIG. 1 is a diagrammatic side view of the relevant part shown partially in section of a complete machine.

The machine shown in FIG. 1 is basically as described in U.S. Pat. No. 3,089,497. It consists of an upwardly extending channel 2 up which tobacco is delivered by means of an airstream towards an air-pervious band 4. Thus a tobacco stream is formed on the band 4 and is held against the band by means of suction applied from a suction chamber 6. The tobacco stream is carried past a trimmer 8 which removes part of the tobacco stream, and the trimmed stream is then deposited on a continuous wrapper web 10 in which it is encloed to form a continuous cigarette rod.

The arrangement shown in FIG. 1 differs from the above patent specification in that the discard tobacco (i.e., the tobacco removed by the trimmer 8) is fed downwards through a pipe 12 and is then delivered, possibly via a subsidiary hopper 13, through a further pipe 14 leading directly into the lower end of the channel 2. It will be seen that the tobacco delivered from the pipe 14 will form the initial layer on the band 4; thus the discard tobacco will remain as part of the trimmed filler stream and will not again be removed by the trimmer.

Other means of feeding the discard tobacco into the lower end of the channel 2 may be used, for example involving other forms of conveyor devices. There may possibly also be an auxiliary hopper which receives the discard tobacco from the trimmer and meters it out to a feeding device which delivers it into the lower end of the channel 2.

Within the suction chamber 6 there is an air cell 16 by which the air-permeability of the tobacco stream is monitored in the manner described in the above-mentioned patent specification. Suction is applied to the air cell from a suction chamber 6 through a pipe 17.

Figure 2:
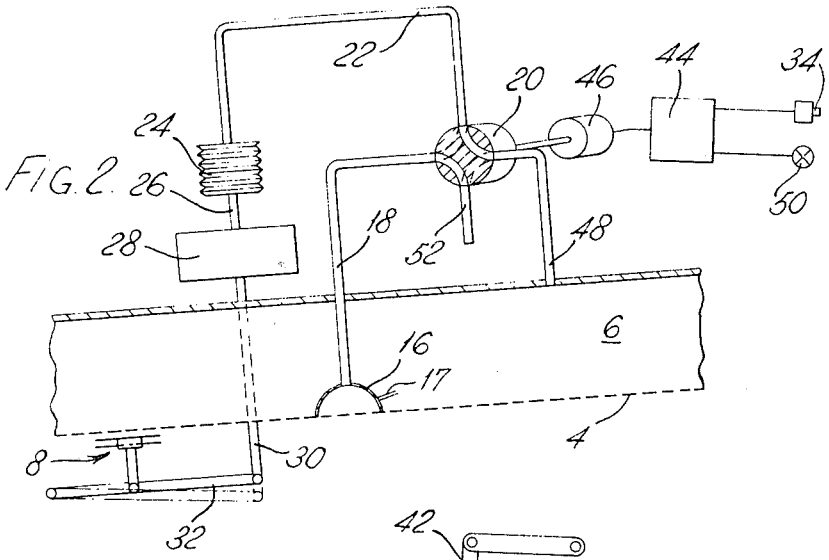
FIG. 2 is a detailed diagrammatic side view partially in section showing means for raising the trimmer during starting of the machine.

FIG. 2 shows how the air cell 16 is connected to control the trimmer. A pipe 18 connected to the air cell normally (i.e., while the machine is running normally) is connected via a valve 20 to a pipe 22 leading to a bellows 24. The bellows 24 translates variations of suction pressure into movement of a mechanical link 26. Movements of the link 26 are in turn transmitted via an hydraulic amplifier 28 to a link 30 pivoted to a lever 32 which in turn is pivoted to the trimmer. As a result, when the suction pressure in the air cell 16 falls, the trimmer 8 is moved downwards; conversely, when the suction pressure in the air cell 16 rises, the trimmer 8 is moved upwards.

The control according to the present invention is achieved as follows. When the machine is started by pressing a button 34, a relay 44 is operated and this connects power to an actuator 46 which rotates the valve 20 to the position shown in FIG. 2. In that position the pipe 22 is connected to a pipe 48 leading to the suction chamber 6, while the pipe 18 is vented to atmosphere. The vacuum in the suction chamber 6 may be approximately 60% higher than the vacuum in the air cell 16, so that the trimmer 8 is moved upwards, for example to a distance of 5 mm from the conveyor band 4 (where the normal average distance may be approximately 10 mm). As soon as a sufficient flow of discard tobacco has been established, a monitoring device 50 (for example, a photo-cell device monitoring the build-up of tobacco in the subsidiary hopper 13) feeds a reverse signal into the relay 44, as a result of which the valve 20 is rotated through 90°, thus, connecting the pipe 22 to the pipe 18; the pipe 48 is then connected to atmosphere through a pipe 52 having a restricted passage similar to that shown at 46 in FIG. 1 of U.S. Pat. No. 3,306,304 to Molins et al.

Figure 3:
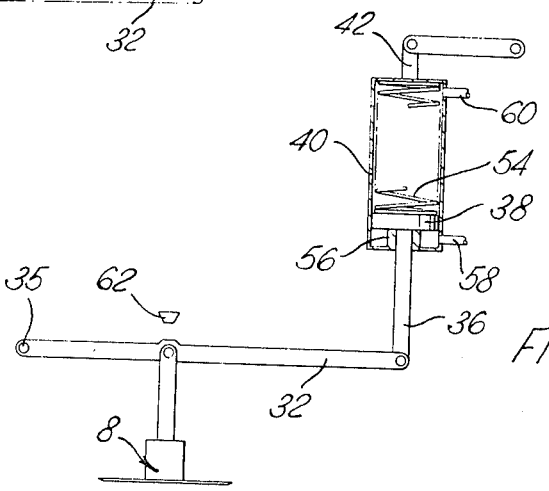
FIG. 3 shows partially in section an alternative to the construction shown in FIG. 2.

FIG. 3 shows an alternative way of moving the trimmer 8 closer to the band while the machine is being started. Again the trimmer is carried by a lever 32 which is pivotally mounted at its left-hand end 35 and is pivotally connected at its right-hand end to a control link which, in this example, consists of a part 36 which carries a piston 38 arranged to slide in a cylinder 40 connected to a part 42. While the machine is running normally, a spring 54 inside the cylinder 40 pushes the piston 38 downwards to a limiting position against an abutment 56. In order to move the trimmer upwards during starting, compressed air is supplied to an inlet pipe 58 below the piston 38 and pushes the piston upwards against the action of the spring 54, air above the piston being exhausted through a vent 60. As a result, the lever 32 swings in an anti-clockwise direction about the end 35 until it abuts a stop 62 which determines the maximum height of the trimmer, which may be approximately 5 mm from the conveyor, as described above.

Instead of admitting compressed air to the inlet 58, suction may be supplied to the passage 60 to raise the piston against the action of the spring.

It will be understood that, in the absence of the provision for moving the trimmer temporarily closer to the conveyor band, there would be a problem in starting the machine. Until the tobacco stream is fully formed, the trimmer could not remove enough tobacco to form the part of the tobacco stream formed by discard tobacco; but the tobacco stream would not be formed without the discard tobacco.

The present invention may also be applied to the cigarette making machines described in U.S. Pat. No. 3,736,941 issued June 5, 1973 (FIG. 9) and in patent application Ser. No. 292,200 filed Sept. 25, 1972. The patent application in particular describes how discard tobacco removed by the trimmer is used to form an initial layer on the conveyor band, the discard tobacco being fed via a subsidiary hopper. The trimmer may be returned automatically to its normal average position when the photo-cell device indicates that there is sufficient tobacco in the subsidiary hopper.

We claim:

1. A cigarette making machine for producing a cigarette rod and comprising conveyor means arranged for movement along a path; means at a first portion of said path for forming on said conveyor means a tobacco stream containing tobacco in excess of that required for said rod, a trimmer at a second portion of said path downstream of said first portion mounted for movement towards and away from said conveyor means and arranged while at a controlled variable distance from said conveyor means to trim away part of the tobacco stream as discard tobacco while the tobacco stream is being carried by the conveyor means; means for feeding the discard tobacco from said trimmer to said conveyor means at the first portion of said path; and means to move the trimmer to a predetermined position closer to said conveyor means than said controlled variable distance, whereby while the machine is being started said trimmer can be moved temporarily to said position closer to said conveyor means to trim tobacco from the tobacco stream which is closer to said conveyor means and build up the trimmed excess tobacco to a predetermined quantity.

2. A machine according to claim 1 wherein said means to move said trimmer is adapted to return said trimmer to said controlled variable distance from said position closer to said conveyor means whereby said trimmer can be maintained at said controlled variable distance after a predetermined flow of discard tobacco from said second portion has been established.

3. A machine according to claim 1 in which the means for forming the tobacco stream comprises means for showering fresh tobacco towards said conveyor means at a first position along the first portion of said path, and including means for showering the discard tobacco towards the conveyor means at a second position along the first portion of said path such that it forms part of the tobacco stream which is not removed by the trimmer.

4. A machine according to claim 3 wherein said means for forming the tobacco stream includes means for feeding the discard tobacco towards the tobacco shower separately from the fresh tobacco delivered into the machine.

5. A machine according to claim 4 including at least one feed device arranged to feed the incoming fresh tobacco towards the fresh tobacco showering means, said feed device being bypassed by the discard tobacco feeding means.

6. A machine according to claim 1 wherein said conveyor means is air-pervious, said machine further comprising a suction chamber adjacent to the conveyor means on the side opposite to the tobacco stream for suctionally holding the tobacco stream on the conveyor means, an air cell mounted in the suction chamber for monitoring the air-permeability of the tobacco stream before trimming, means for maintaining the air cell at a suction pressure which is less than the suction pressure in the suction chamber, an amplifier responsive to suction pressure and arranged to regulate the controlled variable distance of the trimmer from the conveyor, means for transmitting the suction pressure in the air cell to said amplifier, and means for connecting the amplifier temporarily directly to the suction chamber, whereby, while the machine is being started, the amplifier may be connected temporarily to the suction chamber to move the trimmer to said predetermined position closer to said conveyor means.

7. A machine according to claim 1 including a link for controlling the position of the trimmer relative to the conveyor means, the link including a piston and cylinder device by which the length of the link can be temporarily changed by means of a fluid input to move the trimmer to said predetermined position closer to said conveyor means while the machine is being started.

8. A machine according to claim 1 further comprising means for controlling movement of said trimmer including means for monitoring the flow of said discard tobacco from said trimmer and for emitting a signal when the flow has reached to a predetermined level, said means to move said trimmer being further operable in response to said signal from said monitoring means, when the flow of said discard tobacco has increased to said predetermined level, to return said trimmer to said controlled variable distance from said conveyor means.

9. A machine according to claim 8 wherein said means for feeding the discard tobacco from said trimmer to said conveyor means includes storage means for receiving and metering out discard tobacco and said monitoring means is adapted to detect the amount of discard tobacco in said storage means.

10. A machine according to claim 9 wherein said monitoring means is a photo-cell for detecting the build-up of discard tobacco in said storage means.

11. A cigarette making machine for producing a cigarette rod comprising conveyor means arranged for movement along a path; means at a first portion of said path for forming on said conveyor means a tobacco stream containing tobacco in excess of that required for said rod, a trimmer at a second portion of said path downstream of said first portion mounted for movement towards and away from said conveyor means between a first location which is a controlled variable distance from said conveyor means to trim away part of the tobacco stream as discard tobacco while the tobacco stream is being carried by the conveyor means and a second location which is a predetermined distance closer to said conveyor means than said first location to trim tobacco closer to said conveyor means from said tobacco stream; means for feeding the discard tobacco from said trimmer to said conveyor means at the first portion of said path; and control means for regulating said movement of said trimmer, said control means being adapted to move the trimmer to said second location, whereby, while the machine is being started, said trimmer can be moved temporarily to said position closer to said conveyor means to trim tobacco closer to said conveyor means and build up the trimmed excess tobacco to a predetermined quantity, and to move the trimmer from said second location to said first location, whereby said trimmer can trim tobacco at said controlled variable distance.

* * * * *